US010208568B2

(12) United States Patent
Hill et al.

(10) Patent No.: US 10,208,568 B2
(45) Date of Patent: Feb. 19, 2019

(54) DOWNHOLE TOOL WITH AN ISOLATED ACTUATOR

(71) Applicant: Schlumberger Technology Corporation, Sugar Land, TX (US)

(72) Inventors: Steven Nicholas Hill, Houston, TX (US); Geoffrey Pinard, Missouri City, TX (US); Megan Laura Buchheit, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 184 days.

(21) Appl. No.: 15/208,779

(22) Filed: Jul. 13, 2016

(65) Prior Publication Data

US 2018/0016870 A1 Jan. 18, 2018

(51) Int. Cl.
*E21B 34/14* (2006.01)

(52) U.S. Cl.
CPC ..... *E21B 34/14* (2013.01)

(58) Field of Classification Search
CPC ..... E21B 34/10; E21B 34/108; E21B 34/14; E21B 34/085; E21B 34/066
See application file for complete search history.

(56) References Cited

U.S. PATENT DOCUMENTS

| | | | | |
|---|---|---|---|---|
| 4,161,219 | A | 7/1979 | Pringle | |
| 4,660,646 | A | 4/1987 | Blizzard | |
| 8,794,330 | B2 * | 8/2014 | Stout | E21B 34/10 166/250.01 |
| 2009/0266555 | A1 | 10/2009 | May et al. | |
| 2010/0006295 | A1 | 1/2010 | Goughnour et al. | |
| 2010/0139923 | A1 | 6/2010 | Biddick | |
| 2012/0138311 | A1 * | 6/2012 | Stout | E21B 34/10 166/373 |

* cited by examiner

*Primary Examiner* — Brad Harcourt
*Assistant Examiner* — Steven A MacDonald

(57) ABSTRACT

A downhole tool in accordance to aspects of the disclosure includes a housing forming a bore to convey a wellbore fluid, an actuating piston moveably disposed in a cylinder located in the housing adjacent to the bore and a barrier fluid isolating the actuating piston from the bore. The downhole tool may include a compensator piston in communication with the barrier fluid and the bore that is moveable to balance the pressure between the barrier fluid and the bore.

13 Claims, 3 Drawing Sheets

DOWNHOLE TOOL WITH AN ISOLATED ACTUATOR

BACKGROUND

This section provides background information to facilitate a better understanding of the various aspects of the disclosure. It should be understood that the statements in this section of this document are to be read in this light, and not as admissions of prior art.

The present disclosure relates generally to wellbore operations and equipment and more specifically to actuation devices for downhole tools (e.g., subsurface tools, wellbore tools) and methods of operation.

Hydrocarbon fluids such as oil and natural gas are produced from subterranean geologic formations, referred to as reservoirs, by drilling wells that penetrate the hydrocarbon-bearing formations. Once a wellbore is drilled, various forms of well completion components may be installed in order to control and enhance the efficiency of producing fluids from the reservoir and/or injecting fluid into the reservoir and/or other geological formations penetrated by the wellbore. In some wells, for example, valves are actuated between open and closed states to compensate or balance fluid flow across multiple zones in the wellbore. In other wells, an isolation valve may be actuated to a closed position to shut in or suspend a well for a period of time and then opened when desired. Often a well will include a subsurface valve to prevent or limit the flow of fluids in an undesired direction.

SUMMARY

A downhole tool in accordance to aspects of the disclosure includes a housing forming a bore to convey a wellbore fluid, an actuating piston moveably disposed in a cylinder located in the housing adjacent to the bore and a barrier fluid isolating the actuating piston from the bore. The downhole tool may include a compensator piston in communication with the barrier fluid and the bore that is moveable to balance the pressure between the barrier fluid and the bore. The downhole tool may include a check valve device, for example disposed with the compensator piston, which is adapted to selectively allow fluid to flow across the compensator piston between the bore and the barrier fluid.

A method according to one or more aspects of the disclosure includes utilizing a downhole tool in a wellbore, the downhole tool including a housing forming a bore to convey a wellbore fluid, an actuating piston moveably disposed in a cylinder that is located in the housing, a barrier fluid isolating the piston seal from the bore; and balancing pressure between the barrier fluid and the bore in response to moving a compensator piston in communication between the barrier fluid and the bore.

A well system includes a downhole tool connected in a tubular string and disposed in a wellbore, the downhole tool including a housing forming a bore to convey a wellbore fluid, an actuating piston moveably disposed in a cylinder located in the housing adjacent to the bore, a barrier fluid isolating the actuating piston from the bore, and a compensator piston in communication with the barrier fluid and the bore that is moveable to balance the pressure between the barrier fluid and the bore.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
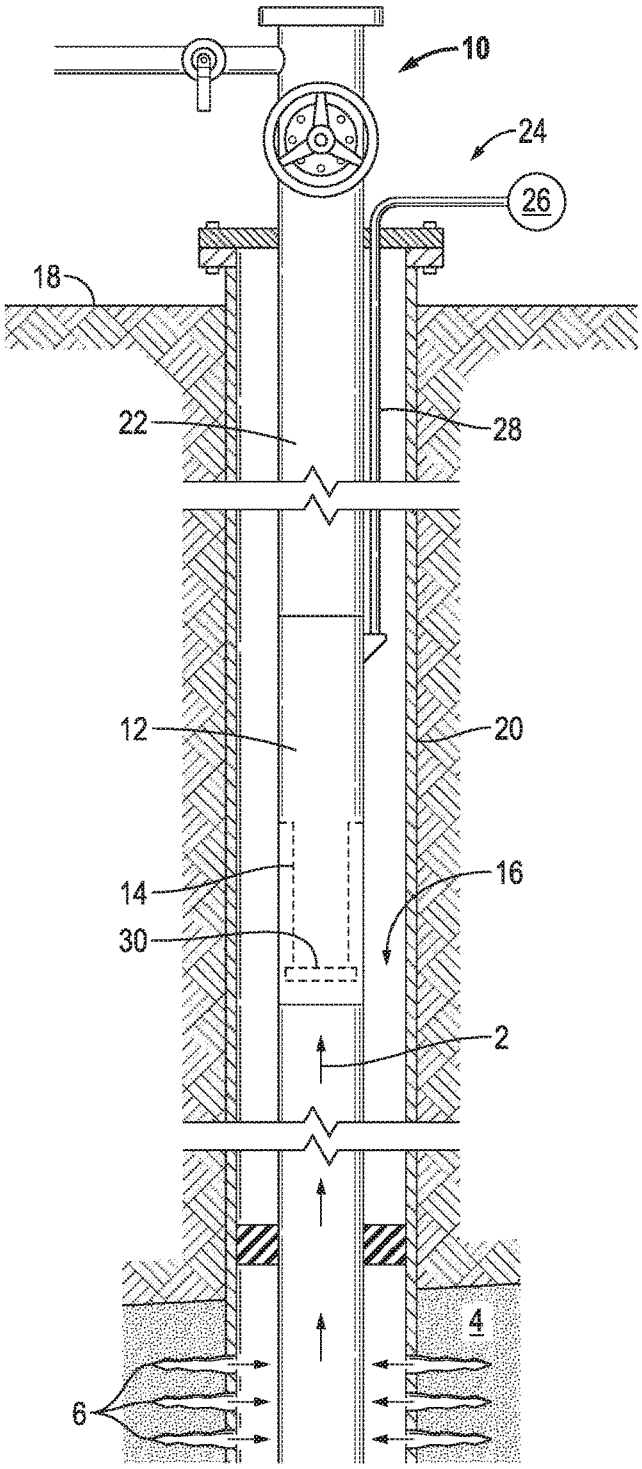
FIG. 1 a schematic of a well system incorporating an embodiment of a downhole tool incorporating an isolated tool actuator according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

In a non-limiting embodiment the downhole tool is a subsurface flow control device or valve in which the tool actuator engages and opens a valve closure member (e.g., flapper, ball, sleeve, etc.). In another embodiment, the tool actuator can progressively operate a variable choke member. The tool actuator includes without limitation devices which are known in the art and commonly referred to as flow tubes and sleeves. The closure member may include various devices such as and without limitation to flappers, ball valves and sleeves. The term piston is utilized in the disclosure to refer to a device that is moved in response to a control signal to actuate a downhole tool. The signal may be, for example, an electric, mechanical, and/or fluidic signal urging the piston to move at least in a first direction. The piston and the control signal (e.g., driving force) may include without limitation a fluidic piston, an electric solenoid, a gear device, and combinations thereof.

Subsurface valves are commonly actuated to a first position (e.g., open) by the application of hydraulic pressure, for example from the surface, and biased to the second position (e.g., closed) by a biasing mechanism (stored energy assembly), such as an enclosed pressurized fluid chamber or a mechanical spring. The fluidic pressure may be applied to a piston and cylinder assembly, for example, that acts against the biasing force of the biasing mechanism to open and hold the valve opened. The biasing force acts on the piston to move it to a position allowing the closure member to move to the closed position when the actuating fluid pressure is reduced below a certain value. Examples of some subsurface valves are disclosed in U.S. Pat. Nos. 4,161,219 and 4,660,646 and U.S. Patent Application Publications 2009/0266555, 2010/0006295 and 2010/0139923, which are all incorporated herein by reference.

FIG. 1 is a schematic of a well system 10 incorporating an embodiment of a downhole tool 12 comprising an actuator assembly 14 according to one or more aspects of the present disclosure. Depicted well system 10 includes a wellbore 16 extending from a surface 18 and lined with casing 20. A tubular string 22 is disposed in wellbore 16. Downhole tool 12 is depicted in FIG. 1 as non-limiting embodiment of a subsurface valve or flow control device, e.g., a subsurface valve. Valve 12 is connected within tubular string 22 for selectively controlling fluid flow through tubular valve 12 and tubular string 22. For example, subsurface valve 12 may be used to block the flow of reservoir fluid 2 through tubular string 22 to the surface when fluid 2 flows from formation 4 through tunnels 6 and into wellbore 16 and tubular string 22 under a greater pressure than desired.

Depicted valve 12 is operated in this example to an open position in response to a signal (e.g., electric signal, fluidic signal, electro-fluidic signal, mechanical signal) provided via control system 24. Depicted control system 24 includes a power source 26 operationally connected to actuator apparatus 14 to operate a tool member 30 (e.g., valve member) from the one position to another position. In FIG. 1, the valve member is in a closed position blocking fluid flow through the bore of the tubular string 22. In the non-limiting embodiment depicted in FIG. 1, control system 24 is a fluidic (e.g., hydraulic) system in which fluidic pressure 26 is provided through control line 28 to actuator apparatus 14 which applies an operational force that moves the actuator apparatus in a first direction engaging and actuating tool member 30 to an open position allowing the reservoir fluid in tubular string 22 to flow across tool member 30. Hydraulic pressure is maintained above a certain level to hold the tool member 30 in the open position. To actuate subsurface valve 12 to the closed position, as shown in FIG. 1, the hydraulic pressure via control line 28 is reduced below a certain level. As is known in the art, the hydraulic pressure is reduced below the level of the force that biases the valve member 30 to the closed position.

Figure 2:
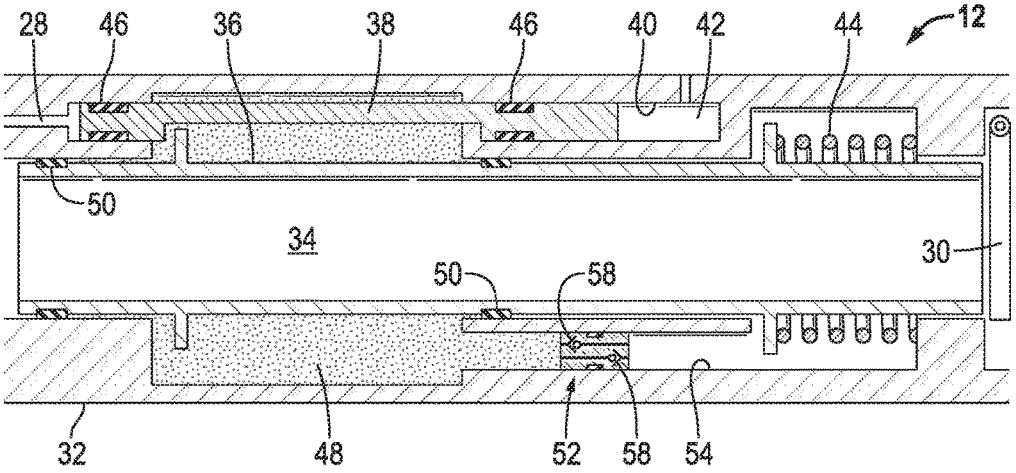
FIG. 2 is a schematic illustration of a wellbore tool utilizing an isolated tool actuator according to one or more aspects of the disclosure.

FIG. 2 illustrates an embodiment of a downhole tool 12 in the form of a subsurface valve and isolated actuation assembly 14 according to one or more aspects of the disclosure. Valve 12 includes a housing 32 having a longitudinal bore 34. Valve member 30 is a flapper in this embodiment. An engaging member 36 (e.g., flow tube, sleeve, tubular member) having a central longitudinal bore co-axially aligned with bore 34 of housing 32 is movably disposed within housing 32. Engaging member 36 is referred to herein as a flow tube. In this embodiment, the valve actuation assembly or apparatus 14 comprises an actuation piston 38 operational disposed with the flow tube 36. Piston 38 is moveably positioned within a cylinder 40. In this example, piston 38 is a balanced piston and a biasing energy source 42 biases piston 38 toward the closed position (upward in the illustrated embodiment). In the depicted embodiments piston 38 is not fixedly, or permanently, connected to the flow tube 36 and a second biasing mechanism 44 biases flow tube 36 toward the closed position. In some embodiments the piston 38 and flow tube may be interconnected to move together in both the first and second directions. Biasing energy source 42 is illustrated as a pressurized fluid and second biasing mechanism 44 is illustrated as a spring.

Figure 3:
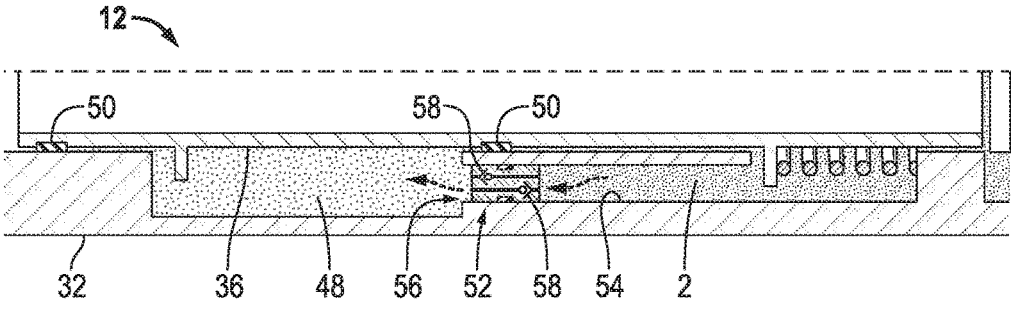
FIGS. 3 and 4 are schematic views of a compensator piston of an isolated tool actuator located at travel limits according to one or more aspects of the disclosure.
Figure 4:
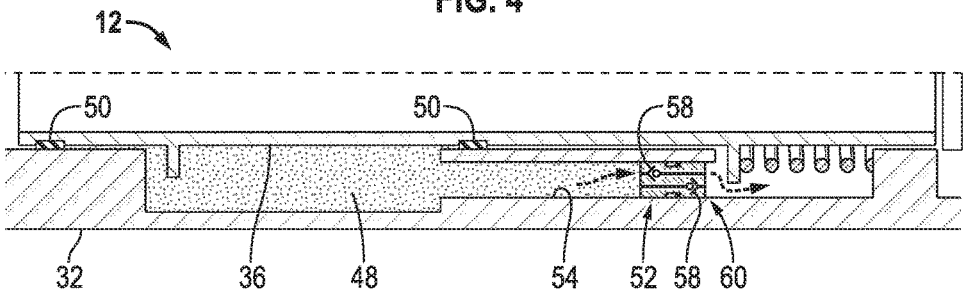
Figure 5:
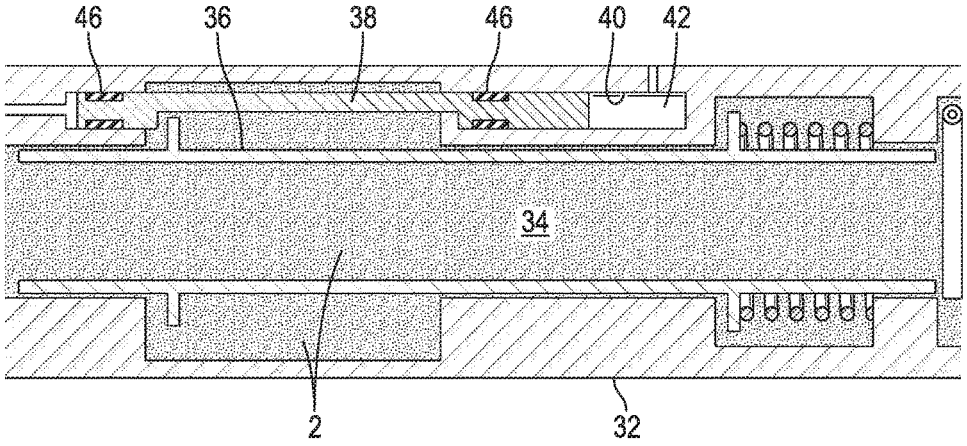
FIG. 5 (Prior Art)
FIG. 5 is a schematic illustration of a prior art subsurface valve with a balanced piston actuator.

Actuating piston 38 includes piston seals 46 sealing the piston in the cylinder 40. In a traditional balanced piston valve design, as illustrated for example in FIG. 5, the piston seals 46 are exposed to the wellbore fluid 2. The isolated actuating assembly or apparatus 14 as depicted for example in FIGS. 2-4 isolates the piston seals 46 from the wellbore fluid.

The isolated from wellbore fluid actuator assembly 14 includes a barrier fluid 48 that is contained with seals 50 on the flow tube 36 and an additional piston 52 disposed in a second cylinder 54 to balance the pressure of the barrier fluid 48 to the wellbore fluid 2, thus reducing the minimum pressure across the flow tube. This additional piston 52, referred to as a compensator piston, is designed so that if it reaches a maximum or minimum position (so that it can no longer balance pressure) it activates a flow control device, e.g., check valves or other process, to allow for fluid (barrier or wellbore) to bypass the compensator piston.

The barrier fluid 48 may be a fluid that is clean relative to the wellbore fluid and may be a selective to be less corrosive than the wellbore fluid. The barrier fluid 48 may provide protection to the piston 38 and/or piston seals 46 from wellbore pressure, chemical properties, state (fluid/gas) and debris in the wellbore fluid. The free floating compensator piston 52 balances, or substantially balances, the pressure across the flow tube 36. The thickness of the flow tube 36 may be minimized as it will not have to withstand high pressure differentials.

As there may be minimal fluid losses (or gains) in the barrier fluid 48 volume, due for example to leakage across the seals 50, the compensator piston 52 must allow fluid bypass if it is no longer able to equalize the pressure. As such, once the compensator piston reaches its maximum operational travel limit positions (uphole or downhole), it will active a check system 58 to allow fluid bypass from the wellbore fluid to the barrier fluid zones.

FIG. 3 illustrates downhole tool 12 with the compensator piston 52 located at a first travel limit 56, for example a maximum travel limit in response to wellbore fluid pressure. This limit may be reached for example in response to the loss of barrier fluid 48 across seals 50. At this first travel limit the wellbore fluid 2 may flow through a check valve system 58 of the compensator piston 52 as illustrated by the arrows and thereby equalize the pressure across the flow tube 36 (between the barrier fluid and the wellbore fluid).

FIG. 4 illustrates downhole tool 12 with the compensator piston 52 located at a second travel limit 60, for example maximum travel limit in response to barrier fluid pressure. At this second travel limit 60 the barrier fluid 48 may flow through the check valve system 58 of the compensator piston 52 as illustrated by the arrows and thereby equalize the pressure across the flow tube.

To open subsurface valve 12, fluid pressure 26 is applied through control line 28 to piston 38 positioned in the cylinder 40 providing a downward force on flow tube 36. The terminal end of the flow tube 36 physically contacts member 30 (valve member), or a lever or other closure member device, moving tool member 30 about a pivot connection to an open position permitting fluid flow through bore 34 opened through valve 12 and flow tube 36 toward the surface. Subsurface valve 12 is maintained in the open position by the maintenance of hydraulic pressure against piston 38.

To close subsurface valve 12, for example due to a pressure kick in the well, the hydraulic pressure can be relieved from control line 28 to a level such that biasing mechanisms 42 moves piston 38 upward and biasing mechanism 44 moves flow tube 36 upward permitting valve member 30 to close. As noted above, the piston and flow tube may be connected in a manner to move in unison in the upward and in the downward directions.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A downhole tool, the downhole tool comprising:

a housing forming a bore to convey a wellbore fluid;

an actuating piston moveably disposed in a cylinder located in the housing adjacent to the bore;

a barrier fluid isolating the actuating piston from the bore;

a compensator piston in communication with the barrier fluid and the bore, the compensator piston moveable to balance the pressure between the barrier fluid and the bore; and a check valve device adapted to selectively allow fluid to flow across the compensator piston between the bore and the barrier fluid.

2. The downhole tool of claim 1, wherein the compensator piston comprises the check valve device.

3. The downhole tool of claim 1, wherein the actuating piston comprises piston seals, the piston seals isolated from the bore by the barrier fluid; and the compensator piston is moveably disposed in a second cylinder located in the housing.

4. The downhole tool of claim 1, further comprising:

a tool actuator operationally coupled with the actuating piston to move in unison with the actuating piston in a first direction; and seals on the tool actuator isolating the actuating piston from the bore, wherein the barrier fluid is contained by the seals.

5. The downhole tool of claim 1, further comprising:

a tool actuator operationally coupled with the actuating piston to move in unison with the actuating piston in a first direction; and seals on the tool actuator isolating the actuating piston from the bore, wherein the barrier fluid is contained by the seals, wherein the compensator piston is moveable to balance the pressure across the tool actuator between the barrier fluid and the bore.

6. The downhole tool of claim 1, wherein the downhole tool is a valve comprising:

a valve member moveably disposed with the housing;

a piston seal located between the actuating piston and the cylinder;

a tool actuator operationally coupled with the actuating piston to move in unison with the actuating piston in a first direction, the tool actuator operable to move the valve member; and seals on the tool actuator isolating the actuating piston from the bore, wherein the barrier fluid is contained by the seals.

7. The downhole tool of claim 6, wherein the tool actuator is disposed between the bore and the barrier fluid.

8. A method, comprising:

utilizing a downhole tool in a wellbore, the downhole tool comprising a housing forming a bore to convey a wellbore fluid, an actuating piston moveably disposed in a cylinder located in the housing, a barrier fluid isolating the piston from the bore;

balancing pressure between the barrier fluid and the bore in response to moving a compensator piston in communication between the barrier fluid and the bore; and selectively allowing fluid to flow across the compensator piston between the bore and the barrier fluid.

9. The method of claim 8, wherein the balancing the pressure further comprises bypassing barrier fluid across the compensator piston to the bore.

10. The method of claim 8, wherein the balancing the pressure further comprises bypassing a wellbore fluid in the bore across the compensator piston to the barrier fluid.

11. The method of claim 8, wherein the balancing the pressure further comprises moving the compensator piston to a travel limit and then permitting a wellbore fluid in the bore to flow across the compensator piston to the barrier fluid or permitting the barrier fluid to flow across the compensator piston to the bore.

12. A well system, the system comprising:

a downhole tool connected in a tubular string and disposed in a wellbore, the downhole tool comprising:

a housing forming a bore to convey a wellbore fluid;

an actuating piston moveably disposed in a cylinder located in the housing adjacent to the bore;

a barrier fluid isolating the actuating piston from the bore;

a compensator piston in communication with the barrier fluid and the bore, the compensator piston moveable to balance the pressure between the barrier fluid and the bore; and a check valve device adapted to selectively allow fluid to flow across the compensator piston between the bore and the barrier fluid.

13. The system of claim 12, further comprising:

tool actuator operationally coupled with the actuating piston to move in unison with the actuating piston in a first direction, the tool actuator operable to move a valve member; and seals on the tool actuator isolating the actuating piston from the bore, wherein the barrier fluid is contained by the seals.

* * * * *